US009310024B2

(12) United States Patent
Plummer et al.

(10) Patent No.: US 9,310,024 B2
(45) Date of Patent: Apr. 12, 2016

(54) METHOD AND SYSTEM FOR FILLING A GAS CYLINDER

(71) Applicant: Scott Technologies, Inc., Monroe, NC (US)

(72) Inventors: Darrill Plummer, Midland, NC (US); Gaylord Posod, Monroe, NC (US); Mavin Carroll, Greensboro, NC (US)

(73) Assignee: Scott Technologies, Inc., Boca Raton, FL (US)

( * ) Notice: Subject to any disclaimer, the term of this patent is extended or adjusted under 35 U.S.C. 154(b) by 86 days.

(21) Appl. No.: 14/097,343

(22) Filed: Dec. 5, 2013

(65) Prior Publication Data

US 2014/0090745 A1 Apr. 3, 2014

Related U.S. Application Data

(62) Division of application No. 12/558,293, filed on Sep. 11, 2009, now abandoned.

(60) Provisional application No. 61/097,091, filed on Sep. 15, 2008.

(51) Int. Cl.
*F17C 5/06* (2006.01)
*F17C 13/00* (2006.01)

(52) U.S. Cl.
CPC ..... *F17C 5/06* (2013.01); *F17C 13/003* (2013.01); *F17C 2201/0109* (2013.01); *F17C 2201/058* (2013.01); *F17C 2205/0338* (2013.01); *F17C 2205/058* (2013.01); *F17C 2221/011* (2013.01);

(Continued)

(58) Field of Classification Search
CPC .... F17C 5/06; F17C 13/003; F17C 2205/058; F17C 2250/0626; F17C 2250/0673
USPC ..... 141/1, 2, 94, 98, 197
See application file for complete search history.

(56) References Cited

U.S. PATENT DOCUMENTS 3,208,574 A 9/1965 Anson ..... 141/197
3,799,218 A 3/1974 Douglass ..... 141/18

(Continued)

FOREIGN PATENT DOCUMENTS

CN 101178781 5/2008
DE 10017252 A1 10/2001

(Continued)

OTHER PUBLICATIONS

RFID; in: Wikipedia, Die freie Enzyklopadie. Bearbeitungsstand: Sep. 10, 2008, URL: http://de.wikipedia.org/w/index.php?title=RFID&oldid=50586133.

(Continued)

*Primary Examiner* — Nicolas A Arnett
(74) *Attorney, Agent, or Firm* — Perkins Coie LLP

(57) ABSTRACT

A charge station is provided for filling a gas cylinder with gas. The charge station includes a gas output port configured to be fluidly connected to a supply of gas. The gas output port is configured to be fluidly connected to the gas cylinder for filling the gas cylinder with gas from the supply of gas. The charge station also includes a control system operatively connected to the gas output such that the control system is configured to control filling of the gas cylinder, and a radio frequency identification (RFID) reader operatively connected to the control system, the RFD reader configured to read data from an RFID tag on the gas cylinder.

7 Claims, 4 Drawing Sheets

(52) U.S. Cl.
CPC ... *F17C 2221/031* (2013.01); *F17C 2223/0123* (2013.01); *F17C 2223/035* (2013.01); *F17C 2227/04* (2013.01); *F17C 2250/032* (2013.01); *F17C 2250/034* (2013.01); *F17C 2250/038* (2013.01); *F17C 2250/043* (2013.01); *F17C 2250/0626* (2013.01); *F17C 2260/015* (2013.01); *F17C 2260/017* (2013.01); *F17C 2270/0194* (2013.01); *F17C 2270/025* (2013.01); *F17C 2270/079* (2013.01); *F17C 2270/0745* (2013.01)

(56) References Cited

U.S. PATENT DOCUMENTS

| | | | | |
|---|---|---|---|---|
| 5,913,344 | A | 6/1999 | Wronski et al. | |
| 6,393,802 | B1 | 5/2002 | Bowser et al. | |
| 6,904,913 | B2 | 6/2005 | Aylsworth et al. | 128/204.22 |
| 7,150,280 | B2 | 12/2006 | Aylsworth et al. | 128/204.22 |
| 7,152,781 | B2 | 12/2006 | O'Dougherty et al. | 235/376 |
| 7,370,791 | B2 | 5/2008 | O'Dougherty et al. | 235/376 |
| 7,415,995 | B2 * | 8/2008 | Plummer et al. | 141/197 |
| 7,619,523 | B2 | 11/2009 | Durtschl et al. | 340/572.1 |
| 7,760,104 | B2 | 7/2010 | Asp et al. | 141/2 |
| 7,762,289 | B2 | 7/2010 | McCulloh et al. | |
| 8,176,948 | B2 | 5/2012 | Carrig | |
| 8,944,119 | B2 * | 2/2015 | Yang et al. | 141/3 |
| 2004/0041709 | A1 | 3/2004 | Forster | 340/603 |
| 2006/0283517 | A1 * | 12/2006 | McCulloh et al. | 141/2 |
| 2007/0008152 | A1 | 1/2007 | Parias | |
| 2007/0113921 | A1 | 5/2007 | Capizzo | |
| 2008/0084306 | A1 | 4/2008 | Durtschi et al. | 340/572.1 |
| 2009/0025824 | A1 | 1/2009 | Niujima et al. | |
| 2009/0140867 | A1 | 6/2009 | Yin et al. | 340/626 |
| 2009/0242074 | A1 | 10/2009 | Carrig | 141/83 |
| 2010/0276033 | A1 * | 11/2010 | Asp et al. | 141/2 |
| 2011/0140850 | A1 * | 6/2011 | Wassel et al. | 340/8.1 |
| 2011/0226382 | A1 * | 9/2011 | Yang et al. | 141/4 |
| 2013/0334236 | A1 * | 12/2013 | Gerstel | 220/724 |

FOREIGN PATENT DOCUMENTS

| | | | |
|---|---|---|---|
| EP | 1054363 | A1 | 11/2000 |
| EP | 1447769 | A1 | 8/2004 |
| EP | 1818596 | A1 | 8/2007 |
| JP | 2002-181296 | A | 2/2002 |
| JP | 2005-321935 | A | 11/2005 |
| JP | 2006-123917 | A | 5/2006 |
| WO | 2007057847 | A2 | 5/2007 |
| WO | 2007070248 | A2 | 6/2007 |
| WO | 2007097152 | A1 | 8/2007 |

OTHER PUBLICATIONS

RFID; in: Wikipedia, the free encyclopedia; Bearbeitungsstand: Sep. 10, 2008; URL: http://en.wikipedia.org/w/index.php?title=Radiofrequency_identification&oldid=237576658.

Transponder; in: Wikipedia—Die freie Enzyklopadie; Bearbeitungsstand: Aug. 25, 2008; URL: http://de.wikipedia.org/w/index.php?title=Transponder&oldid=49960016.

Transponder; in: Wikipedia, the free encyclopedia; Bearbeitungsstand: Sep. 10, 2008; URL: http://en.wikipedia.org/w/index.php?title=Transponder&oldid=237 491016.

* cited by examiner

METHOD AND SYSTEM FOR FILLING A GAS CYLINDER

CROSS REFERENCE TO RELATED APPLICATIONS

This application is a divisional of U.S. patent application Ser. No. 12/558,293 filed Sep. 11, 2009, which claims priority to and the benefit of the filing date of U.S. Provisional Patent Application No. 61/097,091, filed Sep. 15, 2008, the contents of both of which are incorporated herein by reference.

BACKGROUND OF THE INVENTION

The subject matter described and/or illustrated herein relates generally to filling gas cylinders with gas, and more particularly, to a method and system for filling a gas cylinder.

Various conditions may be met to properly and safely fill gas cylinders with gas. For example, various cylinder fill pressures exist for gas cylinders. If a gas cylinder is filled with the wrong pressure, the cylinder will not be completely filled or an overpressure will result, which may rupture an overpressure disc of the cylinder. Gas cylinders may also need to be periodically hydrostatically tested to ensure safe filling. Moreover, each gas cylinder has a specific service life based on the type of cylinder. Expired gas cylinders must be removed from service when the service life has expired. Moreover, if the hydrostatic test date or service life of a gas cylinder has expired, the cylinder should not be refilled.

At least some known gas cylinder filling systems use a manual process whereby a trained operator inspects each gas cylinder prior to filling to obtain the necessary information for properly and safely filling the cylinder. For example, at least some known processes for filling gas cylinders with gas require a visual inspection of the cylinder by a trained operator before the cylinder is filled. Operators may therefore need to be trained to properly inspect gas cylinders. For example, operators may need to be trained to determine the operating pressure of each cylinder and to manually set the filling system to the determined fill pressure. If the operator fails to set the fill pressure to the proper value, the cylinder may be insufficiently filled or the overpressure disc in the cylinder may rupture. Operators may also need to be trained to examine a manufactured date, an expiration date, and/or a hydrostatic test date on each gas cylinder to determine whether the cylinder should be in service before filling. For example, if the cylinder hydrostatic test date or service life has expired and is not observed by the operator, there is an increased risk of the cylinder failing during filling or operation. Moreover, maintenance and record keeping of cylinders may be required to ensure that cylinders are hydrostatically tested when required and/or have been taken out of service once service life has expired.

There is a need for a gas cylinder filling system that may be operated by an operator having less training as compared to at least some known gas cylinder filling systems. There is a need for a gas cylinder filling system that may reduce a number of operator errors as compared to at least some known gas cylinder filling systems.

BRIEF DESCRIPTION OF THE INVENTION

In one embodiment, a charge station is provided for filling a gas cylinder with gas. The charge station includes a gas output port configured to be fluidly connected to a supply of gas. The gas output port is configured to be fluidly connected to the gas cylinder for filling the gas cylinder with gas from the supply of gas. The charge station also includes a control system operatively connected to the gas output such that the control system is configured to control filling of the gas cylinder, and a radio frequency identification (RFID) reader operatively connected to the control system, the RFID reader configured to read data from an RFID tag on the gas cylinder.

In another embodiment, a gas cylinder filling system is provided for filling a gas cylinder with gas. The gas cylinder filling system includes a supply of gas and a charge station. The charge station includes a gas output port fluidly connected to the supply of gas. The gas output port is configured to be fluidly connected to the gas cylinder for tilting the gas cylinder with gas from the supply of gas. The charge station also includes a control system operatively connected to the gas output such that the control system is configured to control filling of the gas cylinder, and a radio frequency identification (RFID) reader operatively connected to the control system, the RFID reader configured to read data from an RFID tag on the gas cylinder.

In another embodiment, a method is provided for filling a gas cylinder with gas using a charge station. The method includes reading data from a radio frequency identification (RFID) tag on the gas cylinder, and filling the gas cylinder with gas based at least in part on data read from the RFID tag on the gas cylinder.

DETAILED DESCRIPTION OF THE INVENTION

Figure 1:
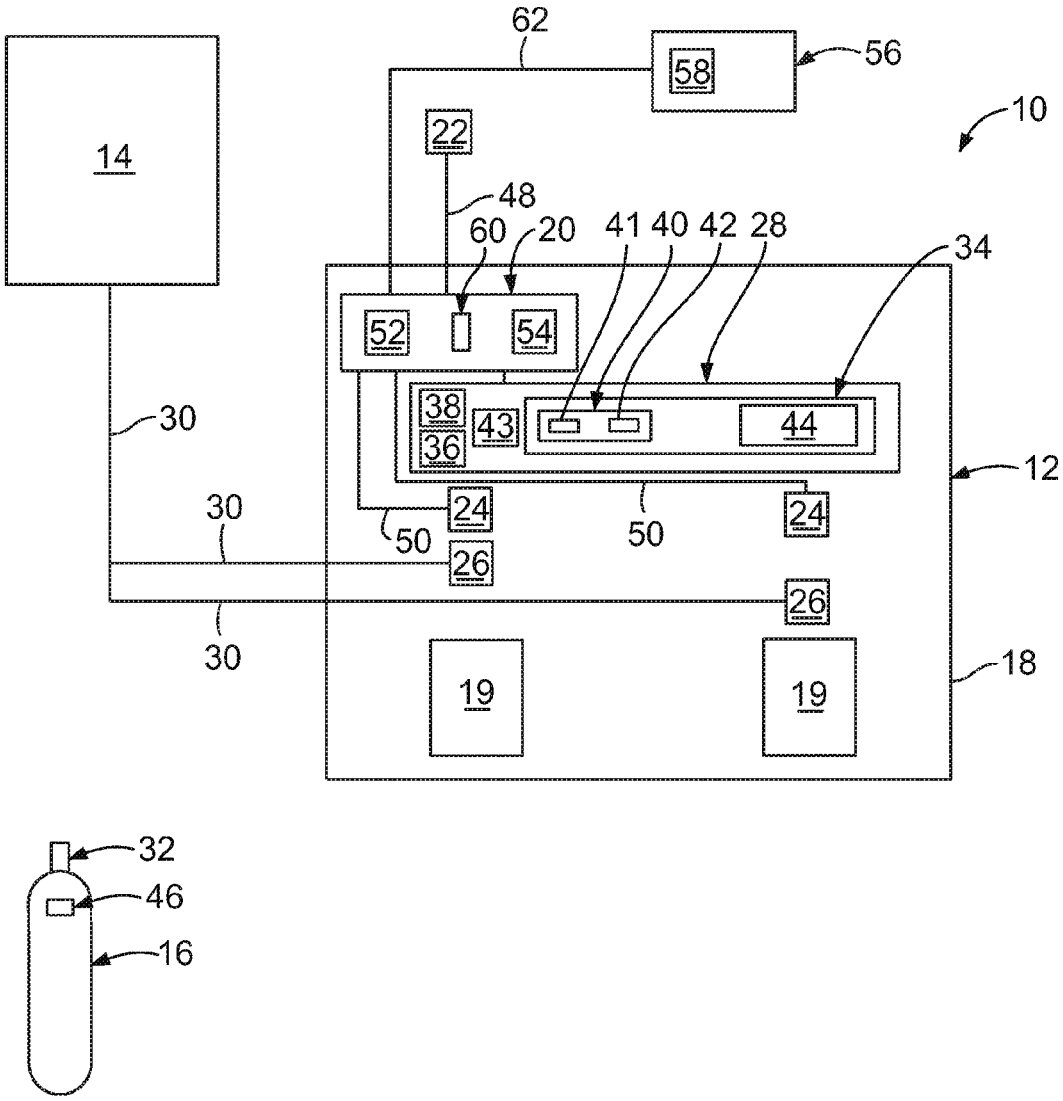
FIG. 1 is a block diagram of an exemplary embodiment of a gas cylinder filling system.
Figure 2:
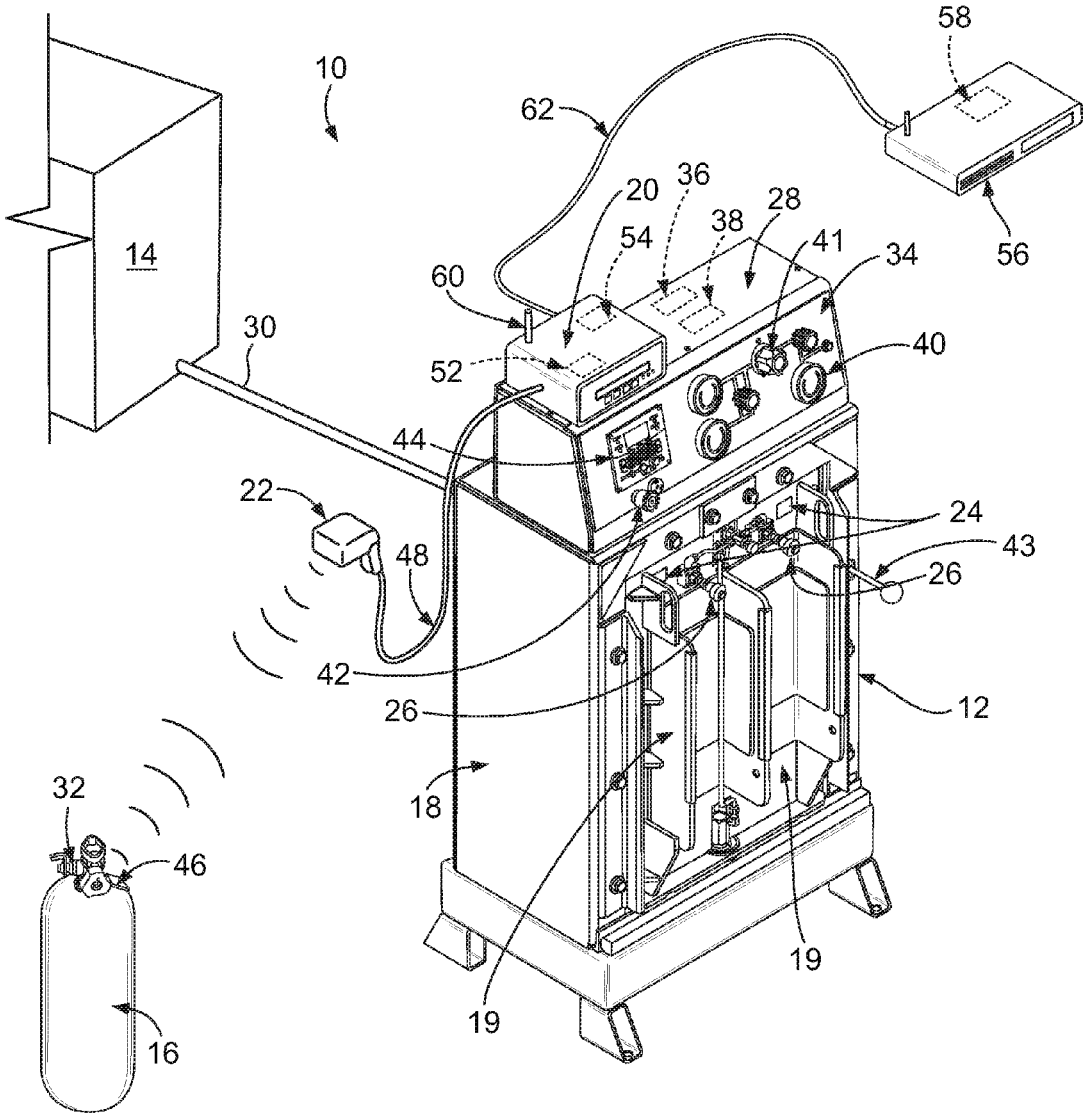
FIG. 2 is a perspective view of the gas cylinder filling system shown in FIG. 1.

FIG. 1 is a block diagram of an exemplary embodiment of a gas cylinder filling system 10. FIG. 2 is a perspective view of the gas cylinder filling system 10. The gas cylinder filling system 10 includes a charge station 12 and a supply of gas 14. As will be described below, the charge station 12 is configured to fill a gas cylinder 16 with a gas. The gas may be any gas, such as, but not limited to, a breathing gas (such as, but not limited to, air, oxygen, nitrox, tirmix, heliox, heliair, hydreliox, hydrox, neox, and/or the like) and/or the like. The gas cylinder 16 may be any type of gas cylinder, such as, but not limited to, a gas cylinder for a self-contained breathing apparatus (SCBA), a space suit, medical equipment, a self-contained underwater breathing apparatus (SCUBA), and/or the like. Although shown as generally cylindrical in shape, in addition or alternatively to the cylindrical shape, the gas cylinder 16 may include any other shape(s).

The charge station 12 includes a housing 18, a data collection system 20, one or more radio frequency identification (RFID) readers 22, one or more RFID readers 24, one or more gas output ports 26, and a control system 28. The housing 18 includes one or more cylinder docks 19 that receive the gas cylinder 16. Each gas output port 26 extends adjacent a corresponding one of the cylinder docks 19 and is fluidly connected to the supply of gas 14, for example via one or more hoses 30. Each gas output port 26 is configured to be fluidly connected to an input port 32 of the gas cylinder 16 for filling the gas cylinder 16 with gas from the supply 14. Specifically, when a gas cylinder 16 is desired to be filled, the gas cylinder 16 is mounted on the cylinder dock 19 and the input port 32 of the gas cylinder 16 is fluidly connected to the gas output port 26. Although two gas output ports 26 and two cylinder docks 19 are shown, the charge station 12 may include any number of gas output ports 26 and any number of cylinder docks 19, for example for simultaneously filling any number of gas cylinders 16.

Figure 3:
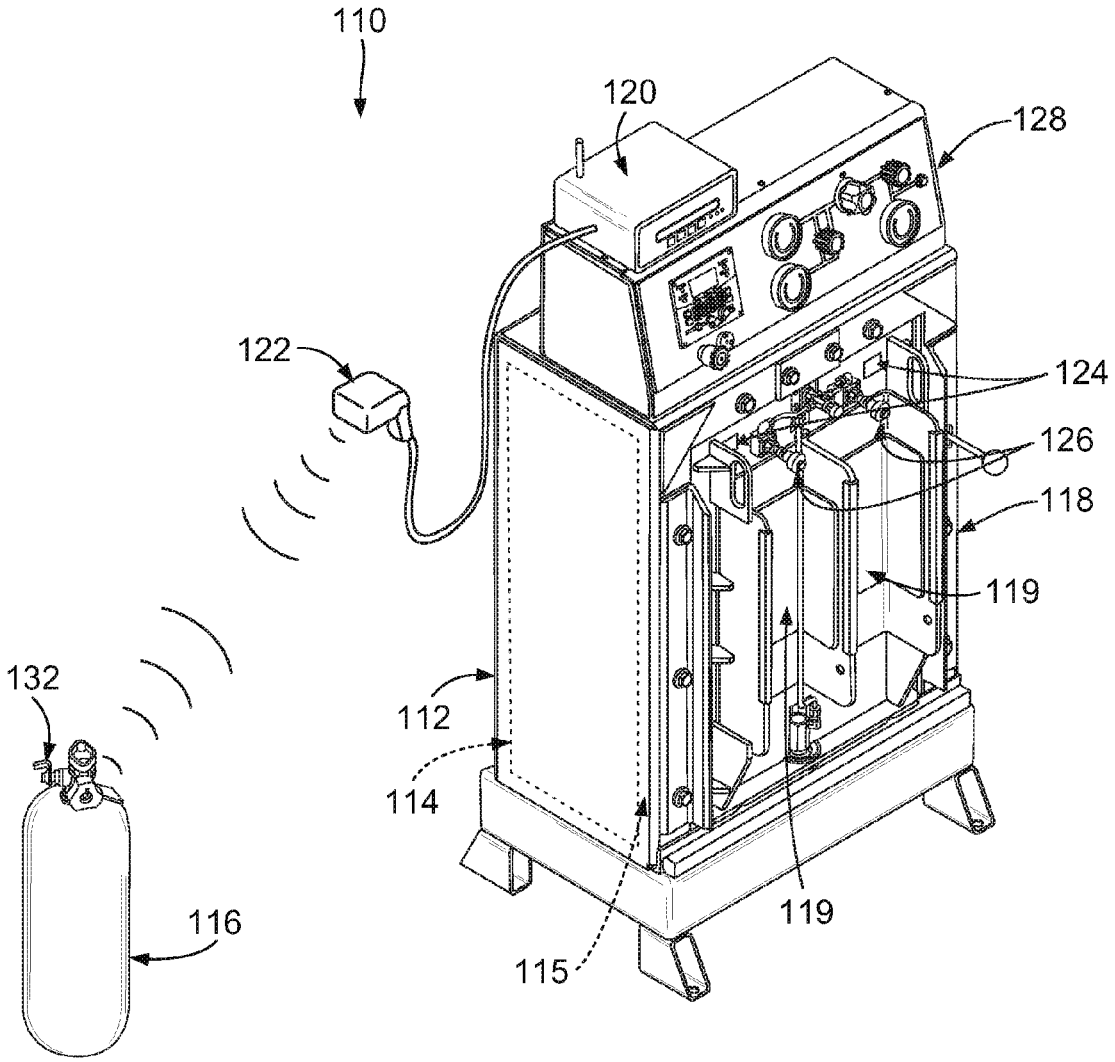
FIG. 3 is a perspective view of an exemplary alternative embodiment of a gas cylinder filling system.

In the exemplary embodiment, the supply of gas 14 is not a component of the charge station 12. For example, in the exemplary embodiment the supply of gas 14 is not held by the housing 18 of the charge station 12. Alternatively, the supply of gas 14 is a component of the charge station 12. For example, FIG. 3 is a perspective view of an exemplary alternative embodiment of a gas cylinder filling system 110. The gas cylinder system 110 includes a charge station 112 and a supply of gas 114. The charge station 112 includes a housing 118, a data collection system 120, one or more radio frequency identification (RFID) readers 122, one or more RFID readers 124, one or more cylinder docks 119, one or more gas output ports 126, and a control system 128. The supply of gas 114 is a component of the charge station 112. For example, in the exemplary embodiment the supply of gas 114 is held within an internal compartment 115 of the charge station housing 118. Each gas output port 126 is fluidly connected to the supply of gas 114. Each gas output port 126 is configured to be fluidly connected to an input port 132 of a gas cylinder 116 for filling the gas cylinder 116 with gas from the supply 114.

Referring again to FIGS. 1 and 2, the control system 28 controls filling of the gas cylinder 16 with gas from the supply 14. In the exemplary embodiment, the control system 28 includes a control panel 34, an optional processor 36, and an optional memory 38. The processor 36 may automatically control some or all portions of the filling process, such as, but not limited to, activating the filling process, deactivating the filling process, selecting parameters of the filling process (such as, but not limited to, selecting a pressure to fill the gas cylinder 16 with and/or the like), and/or the like. The control system 28 includes an activation input 43 that enables an operator to manually start filling the gas cylinder 16 with gas. In the exemplary embodiment, the activation input 43 is remote from the control panel 34. Alternatively, the control panel 34 includes the activation input 43. The control panel 34 optionally includes inputs 40 that enable an operator to manually control some or all of the filling process, such as, but not limited to, activating the filling process, deactivating the filling process, selecting parameters of the filling process (such as, but not limited to, selecting a pressure to fill the gas cylinder 16 with and/or the like), and/or the like. In the exemplary embodiment, the control panel 34 includes a fill pressure input 41 and an emergency stop input 42. The fill pressure input 41 enables an operator to manually select the pressure to fill the gas cylinder 16 with from a range of fill pressures. The emergency stop input 42 enables an operator to stop filling the gas cylinder 16 with gas. The control panel 34 optionally includes a display 44 for displaying, such as, but not limited to, warnings, indications, parameters of the filling process, and/or the like.

The RFID readers 22 and 24 are each configured to read data from one or more RFID tags 46 on the gas cylinder 16. The RFID reader 22 is a hand-held RFID reader. The RFID reader 24 is fixedly mounted on the housing 18 of the charge station 12. In the exemplary embodiment, the RFID readers 22 and 24 are each operatively connected to the data collection system 20 using a respective electrical cable 48 and 50 (the electrical cable 50 is not visible in FIG. 2). However, the RFID readers 22 and 24 may each be connected to the data collection system 20 using any suitable means, such as, but not limited to, using a wireless transmitter (not shown).

The data collection system 20 is operatively connected to the control system 28 for automatically controlling some or all portions of the filling process, such as, but not limited to activating the filling process, deactivating the filling process, selecting parameters of the filling process (such as, but not limited to, selecting a pressure to fill the gas cylinder 16 with and/or the like), and/or the like. The data collection system 20 optionally includes one or more memories 52 configured to store data, such as, but not limited to, data read from the RFID tag 46 by the RFID reader 22 and/or 24, data related to the gas cylinder 16, data related to the gas cylinder system 10 (including data related to the charge station 12), and/or the like. The data read from the RFID tag 46 by the RFID reader 22 and/or 24, the data related to the gas cylinder 16, and the data related to the gas cylinder filling system 10 (including data related to the charge station 12) may include, but is not limited to, a serial number of the gas cylinder 16, an operating pressure of the gas cylinder 16, a hydrostatic test date of the gas cylinder 16, a manufactured date of the gas cylinder 16, a type of the gas cylinder 16, an end of life date of the gas cylinder 16, an early warning of upcoming cylinder obsolescence of the gas cylinder 16, an upcoming hydrostatic test requirement of the gas cylinder 16, frequency of usage of the gas cylinder 16, a utilization of the gas cylinder 16, justification for additional equipment related to the gas cylinder 16, the charge station 12, and/or the system 10, a location of the gas cylinder 16, a filling date of the gas cylinder 16, an identification of the system 10, a location of the system 10, a current date, a current time, ambient air sample data, and an identification of an operator.

The data collection system 20 optionally includes one or more processors 54 operatively connected to the memory 52, the RFID readers 22 and/or 24, and/or any component of the control system 28. The processor 54 may receive data from the memory 52, the memory 38, another component of the control system 28, and/or from the RFID readers 22 and/or 24. The data received from the memory 52, the memory 38, another component of the control system 28, and/or the RFID readers 22 and/or 24 may include, but is not limited to, data read from the RFID tag 46 by the RFID readers 22 and/or 24, data related to the gas cylinder 16, data related to the gas cylinder filling system 10 (including data relating to the charge station 12), and/or the like. The processor 54 may make various decisions and/or may take various actions based on the data received from the memory 52 the memory 38, another component of the control system 28, and/or the RFID readers 22 and/or 24. For example, the processor 54 may automatically control some or all portions of the filling process, such as, but not limited to, activating the filling process, deactivating the filling process, selecting parameters of the filling process (such as, but not limited to, selecting a pressure to fill the gas cylinder 16 with and/or the like), and/or the like. Exemplary decisions and/or actions of the processor 54 are described below with respect to FIG. 4. The processor 54 is not limited to the decisions and/or actions illustrated in FIG. 4 and described with respect thereto.

The processor 54 may transmit data to an optional storage system 56 that is not a component of the charge station 12. For example, the processor 54 may transmit data to a memory 58 of the storage system 56. The processor 54 may transmit data read from the RFID tag 46 by the RFID readers 22 and/or 24, data related to the gas cylinder 16, data related to the gas cylinder filling system 10 (including data related to the charge station 12), and/or the like. The processor 54 may transmit the data using any suitable means, such as, but not limited to, using an optional wireless data transmitter 60 of the data collection system 20 and/or using an optional cable 62 of the data collection system 20. The processor 54 may write data to the memory 52, the memory 38, the memory 58, and/or the RFID tag 46. The processor 54 may write data read from the RFID tag 46 by the RFID readers 22 and/or 24, data related to the gas cylinder 16, data related to the gas cylinder filling system 10 (including data related to the charge station 12), and/or the like. Moreover, the RFID readers 22 and/or 24 may each write data to the memory 52, the memory 38, the memory 58, and/or the RFID tag 46. The RFID readers 22 and/or 24 may each write data read from the RFID tag 46 by the RFID readers 22 and/or 24, data related to the gas cylinder 16, data related to the gas cylinder filling system 10 (including data related to the charge station 12), and/or the like.

Figure 4:
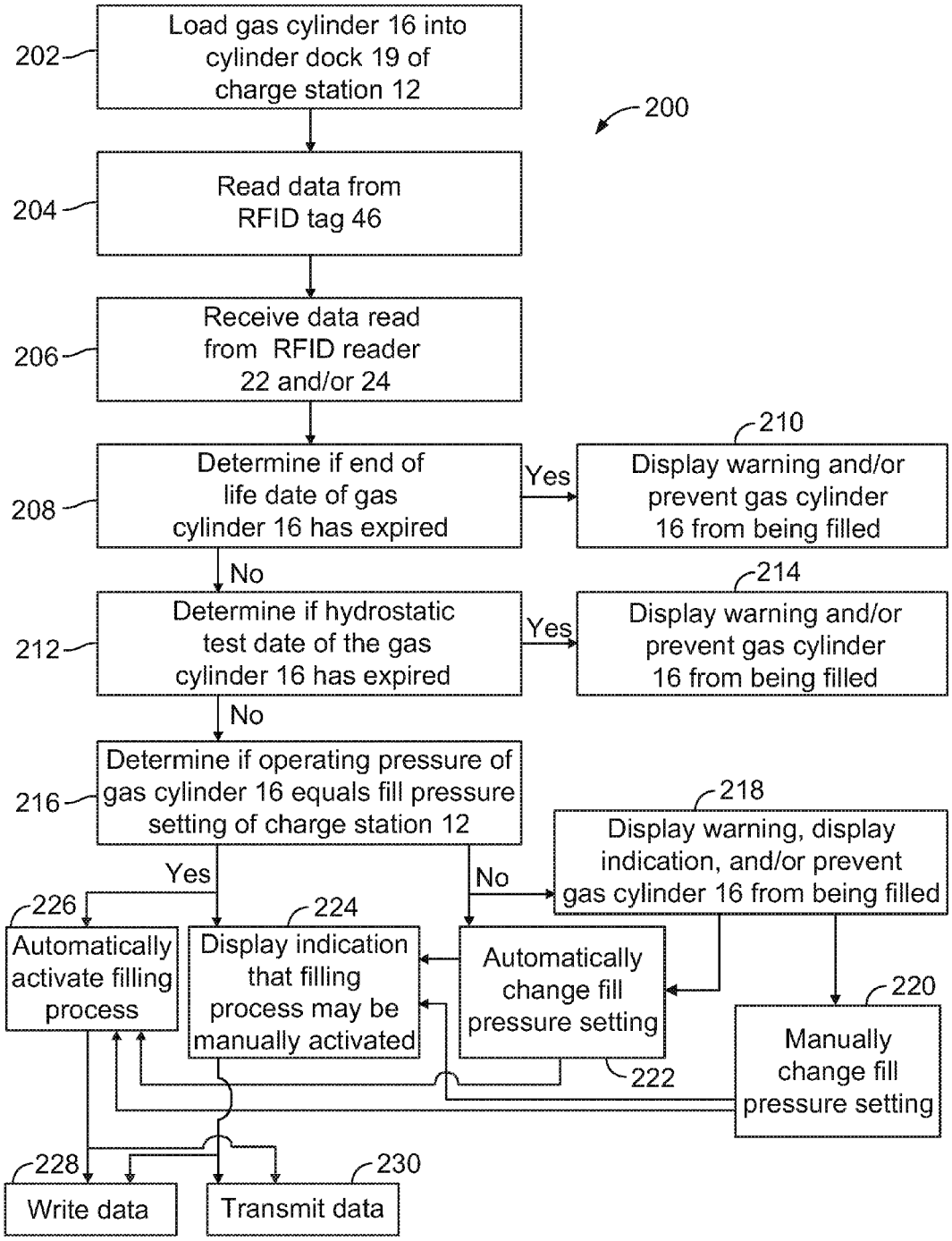
FIG. 4 is a flowchart illustrating an exemplary embodiment of a method for filling a cylinder with gas using the gas cylinder filling system shown in FIGS. 1 and 2.

FIG. 4 is a flowchart illustrating an exemplary embodiment of a method 200 for filling the gas cylinder 16 (FIGS. 1 and 2) with gas using the gas cylinder filling system 10 (FIGS. 1 and 2). The method 200 may include, but is not limited to including, the following steps. Steps of the method 200 described and/or illustrated herein may also be omitted from the method 200. An empty or partially filled gas cylinder 16 is loaded 202 into a cylinder dock 19 (FIGS. 1 and 2) of the charge station 12 (FIGS. 1 and 2). Loading 202 the gas cylinder 16 into the cylinder dock 19 may include orienting the RFID tag 46 (FIGS. 1 and 2). Data is read 204 from the RFID tag 46 using the RFID reader 22 (FIGS. 1 and 2) and/or the RFID reader 24 (FIGS. 1 and 2). The data read 204 from the RFID readers 22 and/or 24 is received 206 by the data collection system 20. The processor 54 determines 208 if an end of life date of the gas cylinder 16 has expired. If the end of life date of the gas cylinder 16 has expired, at step 210 the processor 54 displays (on the display 44 or a display, not shown, of the system 20) a warning that the end of life date has expired, displays a warning that the gas cylinder 16 should not be filled by the charge station 12, displays a warning that the gas cylinder 16 should be removed from service, prevents the gas cylinder 16 from being filled with gas by the charge station 12, and/or the like.

If the end of life date of the gas cylinder 16 has not expired, at step 212 the processor 54 determines whether a hydrostatic test date of the gas cylinder 16 has expired. If the hydrostatic test date of the gas cylinder 16 has expired, at step 214 the processor 54 displays a warning that the cylinder hydrostatic test date has expired, displays a warning that the gas cylinder 16 should not be filled by the charge station 12, displays a warning that the gas cylinder 16 should be removed from service, prevents the gas cylinder 16 from being filled with gas by the charge station 12, and/or the like.

If the hydrostatic test date of the gas cylinder 16 has not expired, at step 216 the processor 54 determines if an operating pressure of the gas cylinder 16 equals a fill pressure setting of the charge station 12. If the operating pressure of the gas cylinder 16 does not equal the fill pressure setting of the charge station 12, at step 218 the processor 54 may display a warning that the operating pressure of the gas cylinder 16 does not equal the fill pressure setting of the charge station 12, may display a warning that the gas cylinder 16 should not be filled by the charge station 12, may prevent the gas cylinder 16 from being filled with gas by the charge station 12, may display an indication that the fill pressure setting of the charge station 12 should be changed, and/or the like. An operator may then manually change 220 the fill pressure setting of the charge station 12 to equal the operating pressure of the gas cylinder 16. In addition or alternative to the any portion(s) of the steps 218 and 220, if the operating pressure of the cylinder 14 does not equal the fill pressure setting of the charge station 12, the processor 54 may automatically change 222 the fill pressure setting of the charge station 12 to equal the operating pressure of the gas cylinder 16.

When the operating pressure of the gas cylinder 16 equals the fill pressure setting of the charge station 12, the processor 54 may display 224 an indication that an operator can manually activate the charge station 12 to fill the gas cylinder 16 with gas. In alternative to manual activation of the charge station 12, the processor 54 may automatically activate 226 the charge station 12 to fill the gas cylinder 16 with gas.

At step 228, the processor 54 and/or the RFID readers 22 and/or 24 may write to the memory 52 (FIGS. 1 and 2), the memory 38 (FIGS. 1 and 2), the memory 58 (FIGS. 1 and 2), and/or to the RFID tag 46: data read from the RFID tag 46 by the RFID readers 22 and/or 24, data related to the gas cylinder 16; data related to the gas cylinder filling system 10 (including data related to the charge station 12), and/or the like. At step 230, the processor 54 may transmit to the storage system 56 (FIGS. 1 and 2): data read from the RFID tag 46 by the RFID readers 22 and/or 14, data related to the gas cylinder 16, data related to the gas cylinder filling system 10 (including data related to the charge station 12), and/or the like.

After filling the gas cylinder 16, the data read from the RFID tag 46 by the RFID readers 22 and/or 24, the data related to the gas cylinder 16, the data related to the gas cylinder filling system 10 (including data related to the charge station 12), and/or the like can be used to track and/or manage a plurality of gas cylinders, Uses of data may include, but are not limited to: early warning of upcoming cylinder obsolescence, upcoming hydrostatic test requirements, frequency of usage, equipment utilization, justification for additional equipment, tracking of cylinder locations, manage other fire department assets (such as, but not limited to, thermal imaging, cameras, SCBA components, regulators, masks, pressure reducers, and/or the like), and/or the like.

The embodiments described and/or illustrated herein may provide a gas cylinder filling system that may be operated by an operator having less training as compared to at least some known gas cylinder filling systems. The embodiments described and/or illustrated herein provide a gas cylinder filling system that may reduce a number of operator errors as compared to at least some known gas cylinder filling systems.

In some embodiments, the data collection system 20 may be a component of the control system 28. Moreover, any functions, method steps, decisions, actions, and/or the like of the processor 54 and the data collection system 20 may be additionally or alternatively performed by the control system 20.

The subject matter described and/or illustrated herein includes a gas cylinder filling system that utilizes an RFID tag and reader to supply data from a gas cylinder to a data collection system and/or a control system for use filling gas cylinders with gas.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. .sctn.112, sixth paragraph, unless and until such claim limitations expressly use the phrase "means for" followed by a statement of function void of further structure.

While the subject matter described and/or illustrated herein has been described and/or illustrated in terms of various specific embodiments, those skilled in the art will recognize that the subject matter described and/or illustrated herein can be practiced with modification within the spirit and scope of the claims.

The invention claimed is:

1. A method for filling a gas cylinder for a self-contained breathing apparatus (SCBA) with gas using a charge station, said method comprising:

reading data from a radio frequency identification (RFID) tag on a gas cylinder said data including at least one of a hydrostatic test date of the gas cylinder, an end of life date of the gas cylinder and an operating pressure of the gas cylinder; and filling the gas cylinder with gas based on data that consists of data read from the RFID tag on the gas cylinder and from data stored in a processor of the charge station, said method further comprising using the data read from the RFID tag to determine if at least one condition of the end of life date of the gas cylinder has expired, the hydrostatic test date of the gas cylinder has expired and the operating pressure of the gas cylinder is not equal to the fill pressure setting of the charge station, and if at least one of said conditions is met, displaying a warning and/or preventing the gas cylinder being filled.

2. A method according to claim 1, wherein filling the gas cylinder with gas comprises automatically filling the gas cylinder using a processor.

3. A method according to claim 1, further comprising storing at least one of data read from the RFID tag by the RFID reader, data related to the gas cylinder, and data related to the charge station.

4. A method according to claim 1, wherein said data further includes at least one of a serial number of the gas cylinder, a manufactured date of the gas cylinder, a type of gas cylinder, an early warning of upcoming cylinder obsolescence of the gas cylinder, an upcoming hydrostatic test requirement of the gas cylinder, frequency of usage of the gas cylinder, a utilization of the gas cylinder, justification for additional equipment related to at least one of the gas cylinder and the gas cylinder filling system, a location of the gas cylinder, a filling date of the gas cylinder, an identification of the charge station, a location of the charge station, a current date, a current time, ambient air sample data, and an identification of an operator.

5. A method according to claim 1, wherein upon determining that the end of life date of the cylinder has expired, a warning is displayed stating at least one of the cylinder end of life date has expired, the cylinder should not be filled by the charge station, and the cylinder should be removed from service.

6. A method according to claim 1, wherein upon determining that the hydrostatic test date of the cylinder has expired, a warning is displayed stating at least one of the cylinder hydrostatic test date of the cylinder has expired, a warning is displayed stating at least one of the cylinder hydrostatic text date has expired, the cylinder should not be filled by the charge station, and the cylinder should be removed from service.

7. A method according to claim 1, wherein upon determining that the operating pressure of the cylinder does not equal the fill pressure setting of the charge station, a warning is displayed stating at least one of the operating pressure of the cylinder does not equal the fill pressure setting of the charge station, the cylinder should not be filled by the charge station, and the fill pressure setting of the charge station should be changed, and/or the fill pressure setting of the charge station is automatically changed to equal the operating pressure of the cylinder, and upon determining that the operating pressure of the cylinder equals the fill pressure setting of the charge station, using the processor to automatically at least one of display an indication that a user can activate the charge station to fill the cylinder with gas, and activate the charge station to fill the cylinder with gas.

* * * * *